US006243872B1

(12) United States Patent
Snedeker

(10) Patent No.: US 6,243,872 B1
(45) Date of Patent: Jun. 12, 2001

(54) COLLAR SYSTEM FOR A FIREFIGHTER'S COAT

(75) Inventor: Julie A. Snedeker, Northwood, NH (US)

(73) Assignee: Globe Manufacturing Company, Pittsfield, NH (US)

( * ) Notice: Subject to any disclaimer, the term of this patent is extended or adjusted under 35 U.S.C. 154(b) by 0 days.

(21) Appl. No.: 09/594,043

(22) Filed: Jun. 15, 2000

(51) Int. Cl.[7] ..... A41D 13/00

(52) U.S. Cl. ..... 2/81; 2/82; 2/86; 2/87; 2/97; 2/98; 2/135

(58) Field of Search ..... 2/81, 82, 86, 87, 2/97, 98, 135, 85, 93, 129, 272

(56) References Cited

U.S. PATENT DOCUMENTS 4,604,759 * 8/1986 Bowman et al. ..... 2/81
5,532,037 * 7/1996 Aumann ..... 2/81
5,638,547 * 6/1997 Hewitt ..... 2/81

* cited by examiner

*Primary Examiner*—Gloria M. Hale
(74) *Attorney, Agent, or Firm*—Dykema Gossett PLLC

(57) ABSTRACT

An outer collar part is permanently secured to the shell body portion and to an inner collar part. A first moisture barrier is disposed adjacent the inner collar part, and a second moisture barrier is disposed between the first moisture barrier and the outer collar part. A third moisture barrier is disposed between the second moisture barrier and the outer collar part. A plurality of spaced lines of stitching connect the third moisture barrier with the outer collar part to form air pockets. A liner includes a thermal barrier and a liner moisture barrier. Cooperating hook and loop fastening portions are supported on the thermal barrier of the liner and the inner collar part to removably secure the thermal barrier to the inner collar part. Further cooperating hook and loop fastening portions are supported on the second moisture barrier and the liner moisture barrier to removably secure the liner moisture barrier to the second moisture barrier and the outer collar portion. Sealing tape is disposed adjacent the further cooperating hook and loop fastening portions to prevent moisture from passing through the second moisture barrier and the liner moisture barrier.

8 Claims, 3 Drawing Sheets

FIG. 5
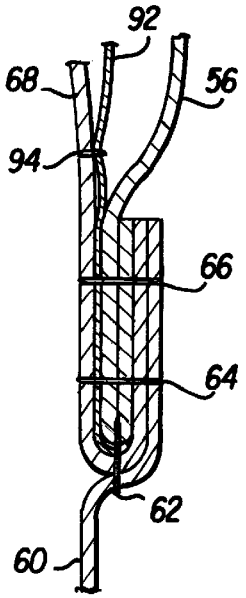
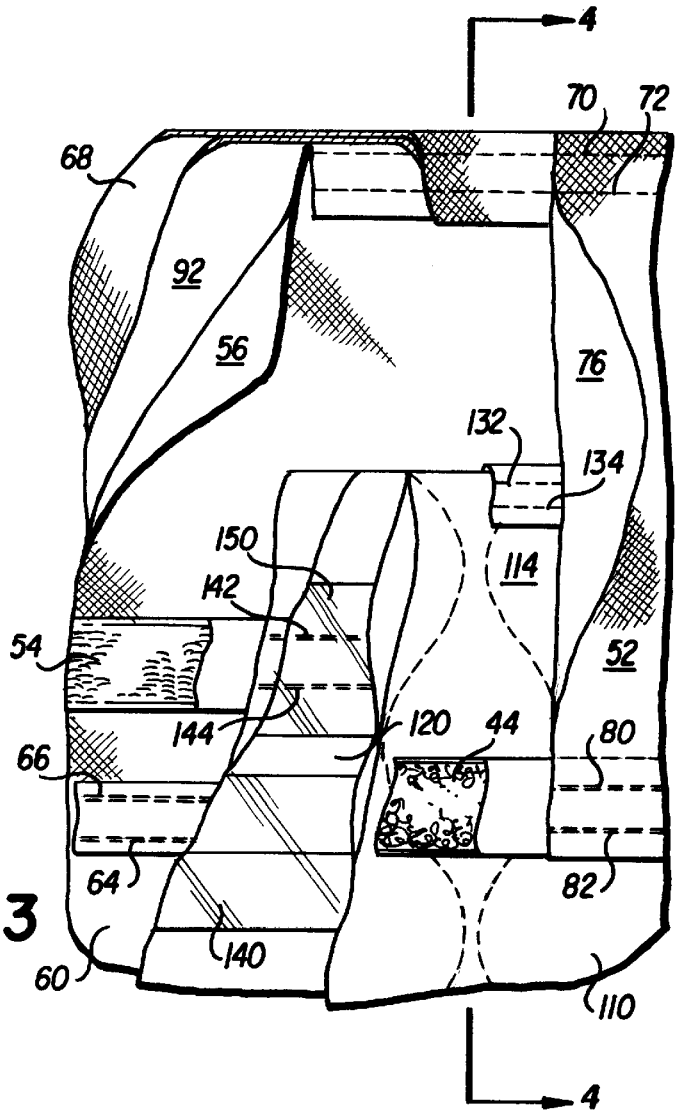
FIG. 3
FIG. 6
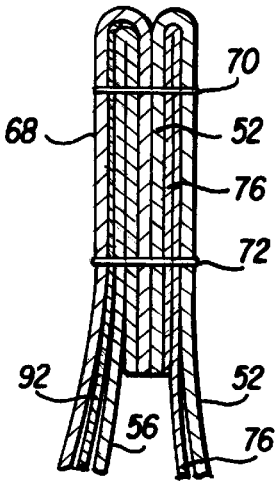
FIG. 7
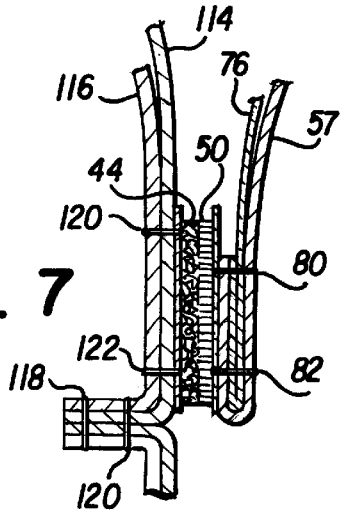

COLLAR SYSTEM FOR A FIREFIGHTER'S COAT

BACKGROUND OF THE INVENTION

The present invention relates to a collar system incorporated into a firefighter's coat. This invention represents an improvement over the construction disclosed in U.S. Pat. No. 5,638,547, the disclosure of which is incorporated herein by reference.

The above patent explains the importance of maintaining water-tight integrity at the juncture of the outer shell and the collar portion of the coat. This is a particular problem when the thermal liners employed with such coats are removable from the shell and collar portion of the coat to enable cleaning protocols to be carried out.

The above patent also discusses the prior art and the problems associated therewith. The objective of the present invention is to provide water-tight integrity at the juncture of the body portion of the shell and the collar portion of the coat, while providing an arrangement which permits a separate thermal liner to be removed from the body portion and the collar portion to be washed and dried when desired. The present invention incorporates a construction which provides superior results when used in firefighting operations.

SUMMARY OF THE INVENTION

An outer shell is stitched to an outer collar part which in turn is stitched to an inner collar part. A first moisture barrier is disposed adjacent to the inner collar part and is stitched thereto. A second moisture barrier is disposed between the inner collar part and the outer collar part and is stitched to the outer collar part. A third moisture barrier is disposed between the second moisture barrier and the outer collar part and is stitched to the outer collar part. A conventional liner has an upper edge portion with hook and loop fastening portions supported on opposite sides thereof. In referring hereinafter to the inwardly and outwardly facing sides of various components of the invention, the collar is assumed to be in an upright operative position so that the collar extends vertically upwardly from the outer shell to protect a firefighter's neck during firefighting activities. A hook and loop fastening portion is supported on the outwardly facing side of the inner collar part for engaging the hook and loop fastening portion on the inwardly facing side of the liner. A further hook and loop fastening portion is supported on the inwardly facing side of the second moisture barrier for engaging the hook and loop fastening portion on the outwardly facing side of the liner. With this arrangement, the liner can be completely removed from the shell and collar portion of the coat and subsequently reattached to the coat in proper operative position.

The liner includes a thermal barrier and a liner moisture barrier which are stitched to one another. The fastening portion on the outwardly facing side of the inner collar part is stitched to the inner collar part and the first moisture barrier, while the cooperating fastening portion on the inwardly facing side of the liner is stitched to the thermal barrier of the liner. The fastening portion on the outwardly facing side of the liner is stitched to the liner moisture barrier, while the cooperating fastening portion on the inwardly facing side of the second moisture barrier is stitched to the second moisture barrier. Conventional seam seal tape is disposed on the inner facing side of the liner moisture barrier adjacent to the fastening portion thereon, and seam seal tape is disposed on the outwardly facing side of the second moisture barrier adjacent to the fastening portion thereon, thereby preventing moisture from passing through the second moisture barrier and the liner moisture barrier at the stitching holding the fastening portions thereon.

The third moisture barrier is stitched to the outer collar part by a plurality of spaced lines of stitching to form air pockets between the third moisture barrier and the outer collar part. These air pockets provide thermal insulation at the inner side of the outer collar part.

BRIEF DESCRIPTION OF THE DRAWINGS

FIG. 3 is an enlarged broken away view of a portion of the collar system of the coat in upright position with certain components folded back to illustrate the construction of the collar portion of the coat;

FIG. 5 is an enlarged view of the portion of FIG. 4 indicated by arrow 5—5;

FIG. 6 is an enlarged view of the portion of FIG. 4 indicated by arrow 6—6; and FIG. 7 is an enlarged view of the portion of FIG. 4 indicated by arrow 7—7.

DESCRIPTION OF THE PREFERRED EMBODIMENT

Figure 1:
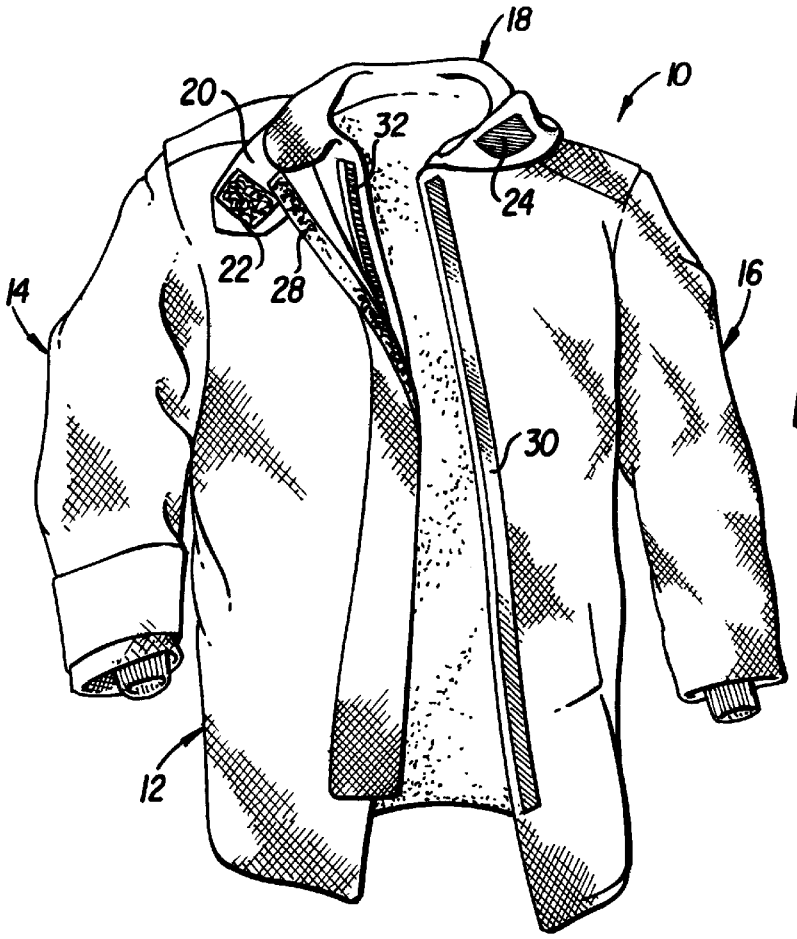
FIG. 1 is a front view of a firefighter's coat incorporating the collar system of the invention, and showing the coat in opened position.
Figure 2:
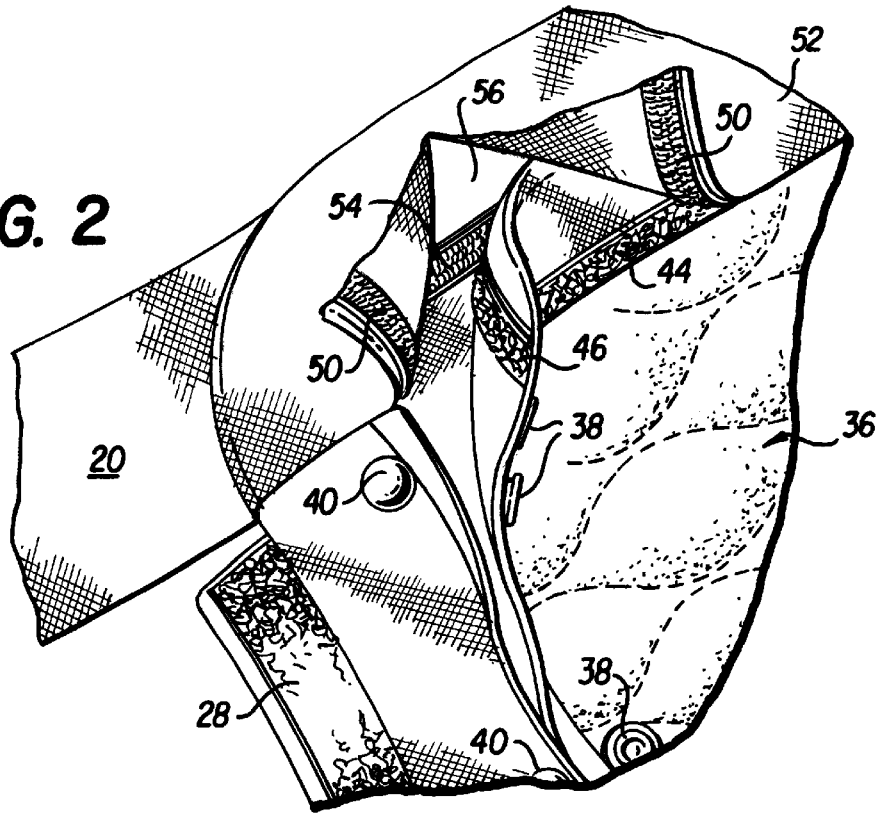
FIG. 2 is top perspective view of a portion of the coat shown in FIG. 1 at the collar portion thereof with certain components folded back to illustrate the manner in which the liner is attached to the shell and collar portion of the coat.

Referring to the drawings wherein like reference characters designate corresponding parts throughout the several views, there is shown in FIGS. 1 and 2 a firefighter's coat 10 including a shell body or torso portion 12 having permanently stitched hereto a pair of sleeves 14 and 16. A collar portion 18 is provided at the upper part of the shell body, and a throat tab 20 is stitched to the collar. A hook and loop fastening portion 22 such as VELCRO is stitched to tab 20 and is adapted to engage a hook and loop fastening portion 24 such as VELCRO stitched to the collar to hold the collar in position when the collar is in upright operative position. The coat is shown in open position and includes a vertically extending VELCRO strip 28 which faces inwardly when in closed position to engage an outwardly facing vertically extending VELCRO strip 30 to hold the coat in closed position. In addition, a zipper portion 32 extends along one front edge of the coat and cooperates with another zipper portion (not shown) which extends along the other front edge of the coat beneath strip 30 to also hold the coat in closed position.

As seen in FIG. 2, a liner 36 has a plurality of male snap fasteners 38 attached thereto which cooperate with a corresponding plurality of female snap fasteners 40 attached to the shell of the coat for detachably connecting the opposite side edges of the liner to the shell in a conventional manner. The upper edge portion of the liner has elongated strips of hook and loop fastening portions 44 and 46 such as VELCRO supported on opposite sides thereof and extending between the opposite side edges of the liner. A hook and loop fastening portion 50 in the form of a strip is supported on the outwardly facing side of the inner collar part 52 (hereinafter more fully described) for engaging fastening portion 44 on the inwardly facing side of the liner. A further hook and loop fastening portion 54 in the form of a strip is supported on the inwardly facing side of a moisture barrier 56 (hereinafter more fully described) for engaging fastening portion 46 on the outwardly facing side of the liner. The combination of the snap fasteners and fastening portions on the liner and collar portion of the coat permit the liner to be completely removed from the shell and collar portion of the coat and subsequently reattached thereto.

Figure 4:
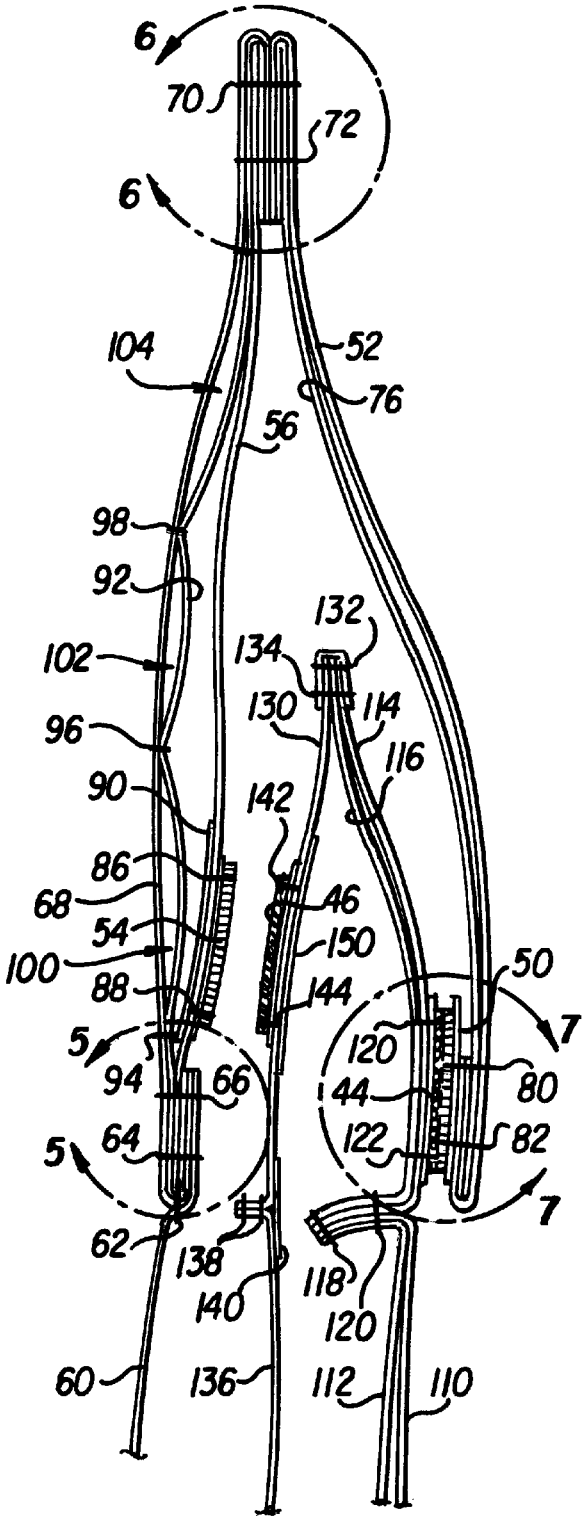
FIG. 4 is an enlarged sectional view taken along line 4—4 of FIG. 3.

Referring to FIGS. 3 and 4, the outer shell 60 at the collar portion is stitched by lines of stitching 62, 64 and 66 to an outer collar part 68 which extends completely around the collar portion. Outer collar part 68 is stitched by lines of stitching 70 and 72 to inner collar part 52 which also extends completely around the collar portion. A moisture barrier 76 is disposed adjacent inner collar part 52 and extends completely around the collar portion. The upper edge of moisture barrier 76 is secured to inner collar part 52 by lines of stitching 70 and 72. The lower edge of moisture barrier 76 is secured to inner collar part 74 by lines of stitching 80 and 82 which also serves to secure fastening portion 50 to the inner collar part 52 and moisture barrier 76.

Moisture barrier 56 is disposed between moisture barrier 76 and outer collar part 68 and extends completely around the collar portion. The upper edge of moisture barrier 56 is secured to outer collar part 68 by lines of stitching 70 and 72. The lower edge of moisture barrier 56 is secured to outer collar part 68 by lines of stitching 64 and 66. Fastening portion 54 is secured to moisture barrier 56 by lines of stitching 86 and 88. In order to prevent moisture from leaking through moisture barrier 56 at stitching 86 and 88, an elongated strip of seam tape 90 is heat sealed in place on the outwardly facing side of moisture barrier 56 and extends all around the collar portion. It is noted that the tape extends above and below the lines of stitching 86 and 88 to ensure a moisture-proof seal.

Another moisture barrier 92 is disposed between moisture barrier 56 and outer collar part 68 and extends completely around the collar portion. The upper edge of moisture barrier 92 is secured to outer collar part 68 by lines of stitching 70 and 72, while the lower edge of moisture barrier 92 is secured to outer collar part 8 by lines of stitching 62, 64 and 66. Moisture barrier 92 is also connected to outer collar part 68 by a plurality of spaced lines of stitching 94, 96 and 98 to create a plurality of air pockets 100, 102 and 104 between moisture barrier 92 and the outer collar part to provide thermal insulation when the collar is in the upright operative position shown in FIG. 4.

As seen in FIG. 4, liner 36 includes a lower face cloth layer 110 and a lower thermal layer 112 of conventional construction which are secured to an upper face cloth layer 114 and an upper thermal layer 116 respectively by lines of stitching 118 and 120. Fastening portion 44 is secured to layers 114 and 116 by lines of stitching 120 and 122. The upper edges of layers 114 and 116 are secured to the upper edge of a liner moisture barrier portion 130. The lower edge of portion 130 is secured to the upper edge of a further liner moisture barrier portion 136 by lines of stitching 138. In order to prevent moisture from passing through the seam between portions 130 and 136, an elongated strip of seam seal tape 140 is heat sealed to the inwardly facing sides of the two portions in overlapping relationship to the seam.

Fastening portion 46 is secured to moisture barrier portion 120 of the liner by lines of stitching 142 and 144. In order to prevent moisture from passing through moisture barrier portion 130 at the lines of stitching, an elongated strip of seam seal tape 150 is heat sealed to the inwardly facing side of portion 130 in overlapping relationship to the lines of stitching.

The invention has been described with reference to a preferred embodiment. Obviously, various modifications, alternatives and other embodiments will occur to others upon reading and understanding this specification. It is my/our intention to include all such modifications, alternatives and other embodiments insofar as they come within the scope of the appended claims or equivalents thereof.

What is claimed is:

1. A collar system for a firefighter's coat comprising, a flame resistant shell including a body portion having left and right sleeve portions, a collar portion including an outer collar part and an inner collar part, said outer collar part being permanently secured to said body portion and to said inner collar part, a separate liner, said liner having an upper edge portion, a first moisture barrier disposed adjacent said inner collar part, a second moisture barrier disposed between said first moisture barrier and said outer collar part, first fastening means for removably securing said upper edge portion of the liner to said inner collar part, and second fastening means for removably securing said upper edge portion of the liner to said second moisture barrier.

2. A collar system as defined in claim 1 wherein said first moisture barrier has upper and lower edge portions each of which is permanently secured to said inner collar part.

3. A collar system as defined in claim 1 wherein said second moisture barrier has upper and lower edge portions each of which is permanently secured to said outer collar part.

4. A collar system as defined in claim 1 wherein said liner includes a thermal barrier and a liner moisture barrier, said first fastening means including a fastening portion supported by said inner collar part and a cooperating fastening portion supported by said thermal barrier of the liner.

5. A collar system as defined in claim 1 wherein said liner includes a thermal barrier and a liner moisture barrier, said second fastening means including a first fastening portion supported by said second moisture barrier and a cooperating second fastening portion supported by said liner moisture barrier.

6. A collar system as defined in claim 5 wherein said second moisture barrier has an inwardly facing side and an outwardly facing side, first sealing means secured to the outwardly facing side of said second moisture barrier adjacent said first fastening portion, said liner moisture barrier having an inwardly facing side and an outwardly facing side, and second sealing means secured to the inwardly facing side of said liner moisture barrier adjacent said second fastening portion.

7. A collar system as defined in claim 1 including a third moisture barrier disposed between said second moisture barrier and said outer collar part.

8. A collar system as defined in claim 7 including a plurality of spaced lines of stitching connecting said third moisture barrier to said outer collar part for creating a plurality of air pockets between said third moisture barrier and said outer collar part.

* * * * *